US005133086A

United States Patent [19]

Truitt et al.

[11] Patent Number: 5,133,086

[45] Date of Patent: Jul. 28, 1992

[54] HOSPITAL GOWN

[76] Inventors: Ann D. Truitt, 1163 12th St., Imperial Beach, Calif. 91932; Patricia C. Southwell, 1533 Nuala St., Concord, Calif. 94518

[21] Appl. No.: 740,107

[22] Filed: Aug. 5, 1991

Related U.S. Application Data

[63] Continuation-in-part of Ser. No. 613,618, Nov. 15, 1990, abandoned.

[51] Int. Cl.[5] ..... A41D 25/02; A41D 25/08

[52] U.S. Cl. ..... 2/114; 2/105; 2/69; 2/DIG. 7

[58] Field of Search ..... 2/75, 69, 80, 105, 104, 2/106, 114, 115, 119, DIG. 7

[56] References Cited

U.S. PATENT DOCUMENTS

| | | | |
|---|---|---|---|
| 302,901 | 8/1884 | Fenne | 2/114 |
| 646,194 | 3/1900 | Sims | 2/114 |
| 1,462,515 | 7/1923 | McElroy | 2/114 |
| 1,766,272 | 6/1930 | Vallier | 2/114 |
| 2,291,861 | 8/1942 | Astrove | 2/80 |
| 2,580,969 | 1/1952 | Stephenson | 2/80 |
| 2,661,472 | 12/1953 | Miller | 2/105 X |
| 2,690,564 | 10/1954 | Kingston et al. | 2/105 |
| 2,701,364 | 2/1955 | Palm | 2/114 |
| 3,276,036 | 10/1966 | Cater | 2/114 |
| 3,369,256 | 2/1968 | Kern | 2/114 |
| 3,570,012 | 3/1971 | Winters | 2/114 |
| 4,031,566 | 6/1977 | Johnson | 2/104 |
| 4,343,046 | 8/1982 | Zebell | 2/105 |
| 4,570,268 | 2/1986 | Freeman | 2/114 |
| 4,686,715 | 8/1987 | Price | 2/114 |
| 4,726,076 | 2/1988 | Douez | 2/80 |
| 4,759,083 | 7/1988 | Belcher | 2/114 |

*Primary Examiner*—Werner H. Schroeder
*Assistant Examiner*—Jeanette E. Chapman
*Attorney, Agent, or Firm*—Baker, Maxham, Jester & Meador

[57] ABSTRACT

A hospital gown with means for fully closing an openable seam, while affording selective access to portions of a patient's body through the seam. The closing or fastening elements are either continuous along the seam or are relatively closely spaced so that no significant gaps remain when all of the closing elements are secured together. Several normally closed and openable seams may be provided in alternative embodiments to afford access to different portions of the patient's body.

9 Claims, 2 Drawing Sheets

HOSPITAL GOWN

CROSS REFERENCE TO RELATED APPLICATION

This is a continuation-in-part of application Ser. No. 07/613,618, filed Nov. 11, 1990 now abandoned.

FIELD OF THE INVENTION

This invention relates generally to hospital gowns and more particularly to a gown which provides selective access to different portions of a patient's body for examination or treatment purposes.

BACKGROUND OF THE INVENTION

Anyone who has had a medical examination and has had to wear a hospital gown or "johnny" has felt discomfort at the least, and quite possibly extreme dislike for the gown and for the need to wear only the gown, no matter how short the time of wearing may be. In addition to impinging upon a patient's modesty there are many practical medical limitations to current hospital gowns. They typically have a full length opening in either the back or front side and may be held together by means of one or two ties. These ties are typically widely spaced, often positioned at the top and possibly at the waist, if there is a second tie at all. The prior art securing means are normally point devices but they may be continuous or elongated closures along one or more seams.

Some prior art gowns are formed of separable pieces which can become separated when openable seams are open. Parts could be lost during laundering or general handling. Examples of this configuration are U.S. Pat. No(s). 818,351; 1,462,515; 4,612,673 and 4,759,083. Many such gowns have openable structural seams. This permits the gown to fall open or off when these seams are opened. For example, see U.S. Pat. No(s). 818,351; 1,462,515; 2,768,383; 3,276,036; 4,612,673; 4,759,083; 4,920,578.

Additionally, doctors are typically pressed for time and dislike the need to place the patient into awkward positions for purposes of conducting exams which typically require the gown to be untied before gaining access to the subject portion of the patient's body. Further, many patients are unable to move easily or at all and it is extremely difficult for a nurse, hospital assistant or physician to get the patient into the appropriate position for a proper exam. In those situations the typical previously known hospital gown may be more of a distraction or a hindrance than a useful covering for the patient. In some instances, the examination or treatment may require complete removal of the gown. This may be true in instances where the patient is connected to some type of external device such as an infusion or transfusion means where tubes may run under the gown down a portion of the length of the patient's body or along the patient's arm to the injection point.

SUMMARY OF THE INVENTION

Broadly speaking, this invention concerns a hospital gown which provides selective access to different portions of a patient's body while at the same time ensuring the complete or nearly complete modesty of the patient.

The gown of this invention is formed with selectively openable, floating seams which are positioned at locations not coincident with the gown's normal structural seams. Those seams are fully closable along their entire lengths by appropriate closure means. The closure means may be selectively openable at any location along the floating seam without the need for opening either end of the seam or any particular length of it. A full length selectively openable and closable seam is also provided.

In alternative embodiments, the gown may be formed with a full-length seam on both front and back sides. Where it is anticipated that it may be necessary to gain access to more than one quadrant of the body for several medical examinations or procedures, the gown may be formed with several openings such as full-length openings on each side of the front of the gown and full-length openings along each side of the back of the gown. Additionally, the sleeves may be openable from the neck to the end of the sleeve to permit application or removal of such devices as tubes for infusion purposes. Several different types of closure elements may be provided to accomplish the desired purposes.

BRIEF DESCRIPTION OF THE DRAWING

The objects, advantages and features of this invention will be more readily appreciated from the following detailed description, when read in conjunction with the accompanying drawing, in which.

DESCRIPTION OF THE PREFERRED EMBODIMENTS

Figure 1:
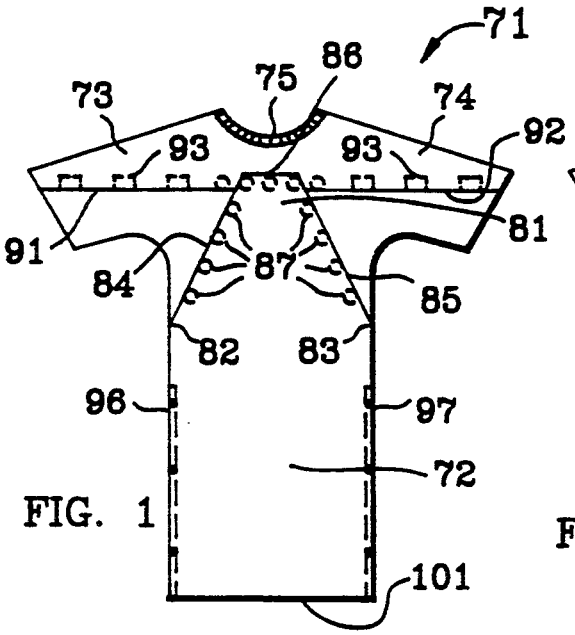
FIG. 1 is an elevational front view of a preferred embodiment of the gown of the invention with openable seams in closed condition.
Figure 2:
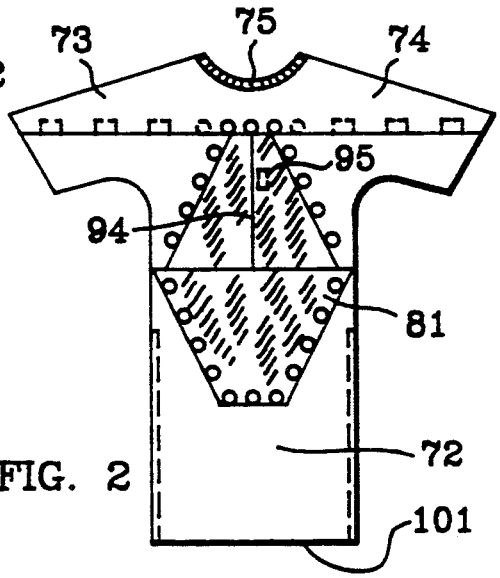
FIG. 2 is a view similar to FIG. 1 with a front panel open.
Figure 3:
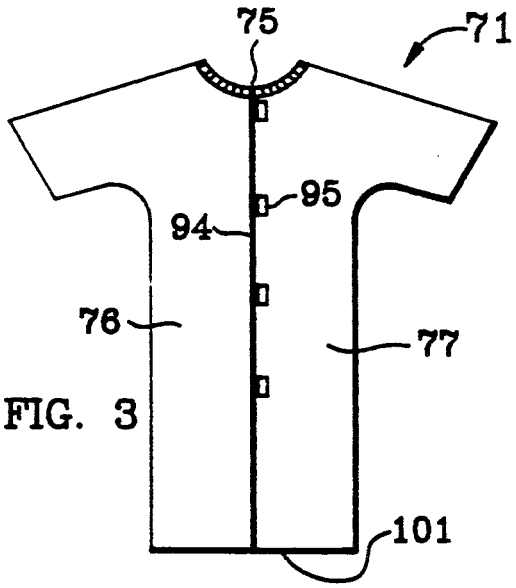
FIG. 3 is an elevational back view of the gown of FIG. 1.

With reference now to the drawing, and more particularly to FIGS. 1–4 thereof, there is shown hospital gown 71 generally comprising front 72, arms 73 and 74, neck 75, and back panels 76 and 77 (FIG. 3). Chest or upper torso access panel 81 is secured at side joining points 82 and 83 and has openable floating seams 84, 85 and 86 which are selectively secured in a closed position by suitable means such as hook and pile elements 87, or snap fasteners or equivalent. The fastening means are of the type which are not detectable on an X-ray. The shoulders and upper arms of the patient are accessible through openable seams 91 and 92 which are selectively secured together by elements 93. Back opening or seam 94 is selectively secured in the closed position by elements 95. Seam 94 need not be centered but it should open all the way through collar 75 as shown in FIG. 3. Access to the lower body quadrants may be made through closable seams 96 and 97 which extend from bottom hem 101 upwardly a substantial distance but short of joining points 82 and 83.

An important aspect of the invention is that the openable and closable seams of the gown, which are provided for emergency or medical procedure access, are not part of its main structural framework. Seams 84, 85, 86, 91 and 92 are free floating. That is, they are located independent from structural seams, with several significant advantages. The structural, normally sewn, seams are in their normal locations, that is, vertically along the sides, across the tops of the shoulders and down the arms of the gown. When front panel 81 is opened, partially or fully, the gown is otherwise intact and the body of the gown supports the rest of the gown (see FIG. 2). No other part of the gown falls away when the front panel is open. When one or both upper chest or shoulder seams 91 and 92 are open, the gown is likewise still fully supported on the patient. With the back seam closed, at least at the collar, even with both seams 91 and 92 open, the neck opening is still continuous and the gown does not fall away from the patient.

Figure 4:
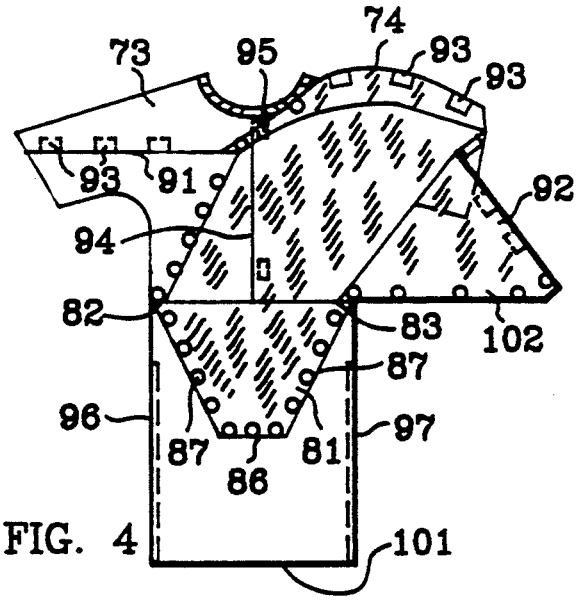
FIG. 4 shows the gown of FIG. 1 with the front and shoulder panels open and an underarm panel folded back.

The versatility of this gown can be appreciated by referring to FIGS. 2 and 4. If access is needed to the upper left quadrant of the patient's body, seams 85 and 92 are opened and lower sleeve portion 102 can be folded away as shown in FIG. 4. Seams 84, 91 and part of seam 86 would remain closed. More of the chest area would be accessed by also folding down front panel 81. The entire upper torso could be accessed by opening seams 84, 85, 86, 91 and 92. Similarly, access to any portion of the back is provided through seam 94. Further aspects of versatility are that the gown may be worn with seam 94 in the front, and the more specific openings being available at the back. It is a unisex garment, one size fits all.

Considering the gown of this invention in the aspect shown, with the front being shown in FIG. 1, it is important to note that there are no front openings in the main framework of the gown, yet there is complete and selective access to all areas of the body from the lower torso to the top. The access panels are totally independent of the structural seams. Because of this structure, when front seams are opened, the body of the gown supports the rest of the gown. With conventional prior art on-seam openings the gown tends to fall away, exposing a much larger portion of the patient than is desired or needed. In other words, this gown provides selective access, yet remains intact. Further, this gown is unitary; pieces cannot be separated during general handling or laundering, even with all openable seams open.

Another advantage of this gown is that the entire garment can be removed and changed while an IV or transfusion is in process without disturbing the involved apparatus. Other advantages are that the back opening overlaps to ensure access without unnecessary exposure, and it is easier for arthritic patients or patients with restricted mobility to open or close the back, all the while responding to desires for maximum coverage for modesty reasons.

Figure 5:
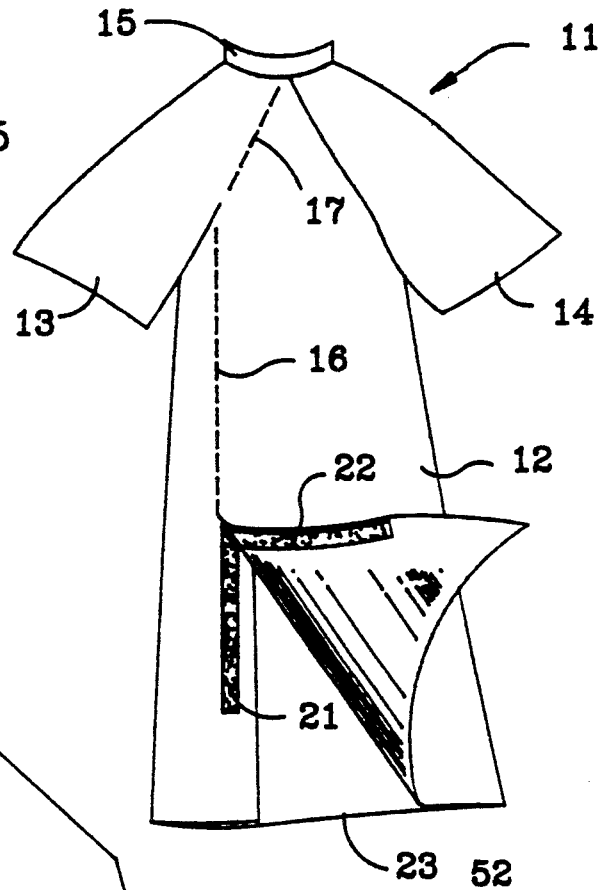
FIG. 5 is an elevational view of an alternative embodiment of the invention showing a full-length selectively openable seam.

With reference now to the alternative embodiment of FIG. 5, there is shown gown 11 formed of body 12, sleeves 13 and 14, neck or collar element 15 and a seam comprised of segments 16 and 17. In this embodiment, the gown incorporates cotton rib knit neck 15 which provides a higher, softer collar than in prior art hospital gowns. This results in a more comfortable and better fit. The gown is fully washable, all fabric bleachable and dryer safe. It is preferred that the gown be made of a cotton/polyester blend.

Seam 16 extends the entire length of body 12 of the gown from the point of contact with sleeve 13. Seam 16 is contiguous with sleeve seam 17 which extends from the upper end of seam 16 at the point where sleeve 13 joins body 12 through neck 15. In one aspect of this embodiment, a pair of mating hook and loop fastener strips 21 and 22 (often referred to under the trademark Velcro) are secured to opposite sides of seams 16 and 17. This structure permits any portion of the gown to be selectively opened only for the length needed and immediately reclosed after the examination or medical procedure is completed. As shown in the drawing, hook and loop fastener strips 21 and 22 commence at a location spaced somewhat above bottom edge or hem 23 of the gown. The length of that unsecurable seam is a matter of choice and would normally be a relatively small percentage of the total length of the seam, possibly eight to twelve inches above the hem.

Figure 6:
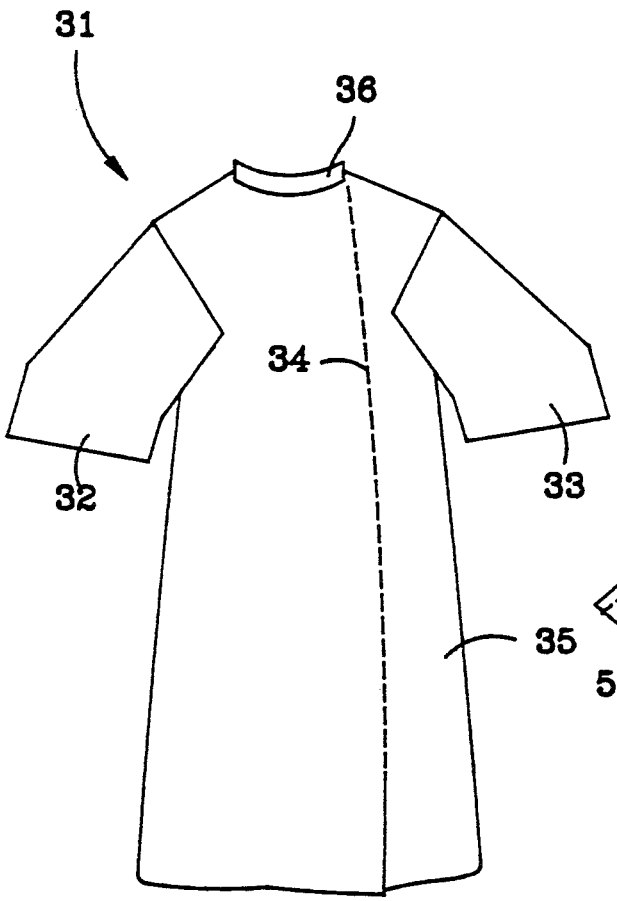
FIG. 6 is a modification of the gown of FIG. 5 to provide selective access to a patient's body.

Gown 31 of FIG. 6 is formed with longer sleeves 32 and 33 than those in FIG. 5. In this embodiment, openable seam 34 extends the full length of body 35, through neck 36, and does not incorporate the sleeve seam as was true of FIG. 5.

The hospital gowns of FIGS. 5 and 6 are unisex and can be worn with the openable seam in the front or in the back. For example, the back opening orientation would be used for spinal exams and procedures and the front opening would be employed for breast exams and the like.

With the gown of FIGS. 5 and 6, it is possible to open any relatively short portion of seam 16, 17 or seam 34, top, bottom or middle, without exposing more of the patient's body than is necessary. This closure means ensures modesty without the previous "flap-in-the-back" exposure worry.

By using hook and loop strips along the openable seam, or discrete plastic snap fasteners or the like, the seam can be openable as desired and the closure means is not X-ray detectable. As an alternative to extended or continuous elongated hook and loop strips, short segments of the same fastener means at spaced intervals could be used. This means of closure would function much like discrete snap fasteners.

Another advantage is that when a patient is connected to diagnostic or treatment devices, for example, tubes for transfusion, or wires for monitoring, access can be gained to the applicable position of the body without removal of the gown.

In another alternative embodiment, a gown may be formed with either seam 16, 17 or seam 34 in both the front and the back so there is equal access to both sides of the patient's body without removing and reversing the gown. Thus there is no question of gown orientation when instructions are given by medical personnel for the patient to put on the gown.

Figure 7:
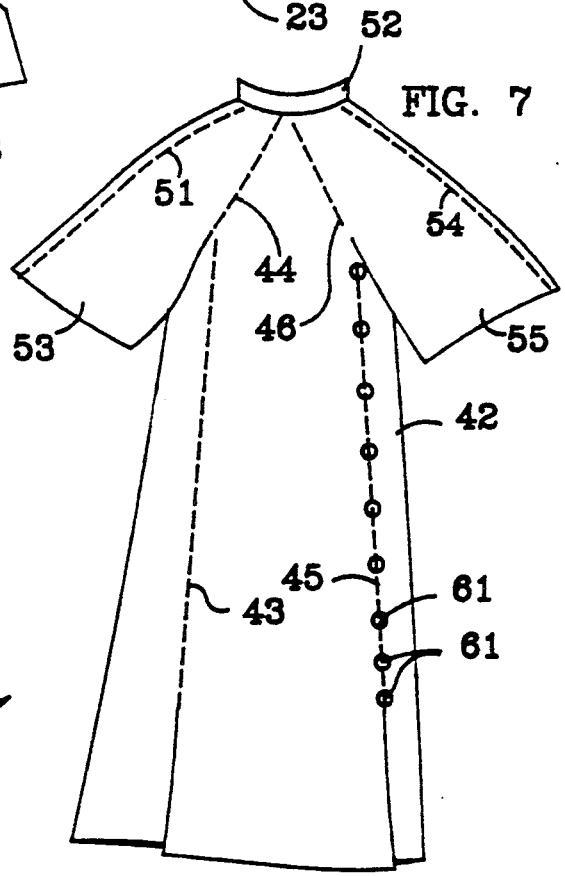
FIG. 7 is another alternative embodiment showing openings to permit selective access to any quadrant of the body and to the upper arms and shoulders of the patient.

The alternative embodiment of FIG. 7 has several selectively openable seams. Gown 41 is formed with body 42 having longitudinal seams 43, 44 and 45, 46, each combination being similar to seam 16, 17 in FIG. 5. This gown may have a similar dual openable seam arrangement on the other side to provide ready access to any quadrant of the patient's body, while continuing to afford reasonable covering for the patient. For patients with multiple medical problems, this embodiment provides continued covering of the patient while affording selective access to substantially any part of the patient's body.

Another feature of the FIG. 7 embodiment is an openable seam in each arm. Seam 51 runs from collar 52 to the end of sleeve 53. Similarly, seam 54 runs from collar 52 to the end of sleeve 55. In many instances, tubes or wires may be located along a patient's arm from the shoulder to some point of application near or in the wrist or hand. This was cumbersome when changes were necessary with prior gowns. Either the tube had to be threaded down the sleeve or the gown had to be removed. With this invention the arm is fully accessible as needed without the need for removal of the gown or threading the tube beneath the collar and sleeve.

Alternative fastening means such as snaps 61 are shown for closing seam 45 in FIG. 7.

In view of the above description, it is likely that modifications and improvements will occur to those skilled in the art which are within the scope of the accompanying claims.

What is claimed is:

1. An elongated reversible front to back hospital gown having a front and a back and opposite sides forming a body portion, shoulders at the top, arms on either side commencing at the respective shoulders, a neck portion between the shoulders and an upper torso being in the normal position below the shoulders and normally having structural seams vertically along the sides, across the shoulders at the top thereof, and down the arms, said gown comprising:

a body portion having at least one first seam along the length of said body portion on the back thereof, said first seam being selectively closable for any portion of its length;

means for closing said first seam so that in use said first seam is fully closed with no discernible gaps, said closing means being configured to permit any segment of said first seam to be opened without the need to open the entire first seam or either end thereof;

a second free floating seam on the front of said body portion, said second seam being horizontally oriented across the upper torso and below the top of the structural shoulder seams and extending from one sleeve arm opening to the other;

means for selectively closing and opening said second seam for its full length and any portion thereof;

collar means at the neck portion adapted to encircle the neck of a patient, said collar means being normally continuous and being interruptible by said first seam when open at said collar;

third free floating seam means on the front of said gown extending from one side adjoining said front and back of said gown upwardly to the general area of said second seam and downwardly to the opposite side adjoining said front and back of said gown; and means for selectively closing and opening said third seam means for its full length and any portion thereof.

2. The hospital gown recited in claim 1, wherein said second seam and said third seam means intersect and selectively open into each other.

3. The hospital gown in claim 1, wherein said second seam and said third seam means are separate from and independent of the structural seams of said gown.

4. The hospital gown recited in claim 1, wherein said closing means comprises hook and loop fastener means positioned along said seams.

5. The hospital gown recited in claim 4, wherein said fastener means comprises spaced segments of hook and pile elements.

6. The hospital gown recited in claim 4, wherein said hook and pile fastener is substantially continuous for the entire length of said selectively openable seams.

7. The hospital gown recited in claim 1, wherein said closing means comprises spaced snap fasteners.

8. The hospital gown recited in claim 1, wherein said gown is unitary and has no separable elements when all openable seams are open.

9. An elongated reversible front to back hospital gown having a front and a back and opposite sides forming a body portion, shoulders at the top, a neck portion between the shoulders and an upper torso being in the normal position below the shoulders and normally having structural seams vertically along the sides, across the shoulders at the top thereof, and down the arms, said gown comprising:

a collar at one end of the body portion at the neck portion for encircling the neck of a patient and a hem at the other end;

a pair of oppositely positioned sleeves extending from said collar of said gown;

at least one first selectively openable seam extending the full length of said gown on the back side thereof, said first seam selectively interrupting the continuity of said collar;

a second selectively openable seam extending across the upper torso below and in front of the top of the shoulders, said second seam extending substantially horizontally from one sleeve opening to the other;

third selectively openable seam means extending from the opposite sides of said gown at points adjoining the front and back thereof upwardly to the vicinity of said second seam to create a front openable panel; and means for closing each said seam in said gown so that in use each said seam is fully closed with no discernible gaps, said closing means being configured to permit any segment of said seam to be opened without the need to open the entire seam or either end thereof;

said second seam and said third seam means being spaced from and free floating with respect to the structural seams of said gown.

* * * * *